US005347262A

United States Patent [19]

Thurmond et al.

[11] Patent Number: 5,347,262

[45] Date of Patent: Sep. 13, 1994

[54] THEFT-DETERRENT DEVICE PROVIDING FORCE-SENSITIVE TAMPER DETECTION

[75] Inventors: Robert C. Thurmond, Largo; Edward J. DiCarlo, New Port Richey; Fred W. Herman, Tampa; Dennis L. Hogan, St. Petersburg; John L. Lynch, Holiday; Hildan B. Russell, St. Petersburg, all of Fla.

[73] Assignee: Security Tag Systems, Inc., Deerfield Beach, Fla.

[21] Appl. No.: 965,914

[22] Filed: Oct. 23, 1992

[51] Int. Cl.[5] ..... G08B 13/24

[52] U.S. Cl. ..... 340/572; 340/505; 340/665

[58] Field of Search ..... 340/572, 665, 505; 24/704.1; 116/203, 211

[56] References Cited

U.S. PATENT DOCUMENTS

| | | | |
|---|---|---|---|
| 4,481,428 | 11/1984 | Charlot, Jr. | 307/219.1 |
| 4,523,356 | 6/1985 | Charlot, Jr. | 24/155 BR |
| 4,649,397 | 3/1987 | Heaton et al. | 340/572 X |
| 4,670,740 | 6/1987 | Herman et al. | 340/572 |
| 4,727,360 | 2/1988 | Ferguson et al. | 340/572 |
| 4,812,811 | 3/1989 | Asbrink et al. | 340/572 X |
| 4,847,592 | 7/1989 | Hogan Esch et al. | 340/572 |
| 4,944,075 | 7/1990 | Hogan | 24/704.1 |
| 5,019,801 | 5/1991 | Anderson, III | 340/572 X |
| 5,031,287 | 7/1991 | Charlot, Jr. et al. | 24/704.1 |
| 5,054,172 | 10/1991 | Hogan et al. | 24/704.1 |
| 5,065,137 | 11/1991 | Herman | 340/572 |
| 5,065,138 | 11/1991 | Lian et al. | 340/572 |

*Primary Examiner*—Thomas Mullen
*Attorney, Agent, or Firm*—Edward W. Callan

[57] ABSTRACT

A pin-and-clutch theft-deterrent device that enables instantaneous detection of separation-force tampering with the theft-deterrent device. The device includes a pin in one component and a clutch assembly in a second component for attaching the device to an article to be protected by grasping the pin with the clutch to provide a predetermined retaining force for resisting separation of the components by prying or pulling the components apart; a force-sensitive switch assembly for detecting application to the two components of at least a predetermined threshold separation force applied in opposition to the predetermined retaining force; and a transponder coupled to the switch assembly for responding to an irradiated interrogation signal by radiating an alarm signal when the switch assembly detects application to the two components of at least the predetermined threshold separation force. A system for detecting attempted removal from a protected article of the theft-deterrence device is installed in proximity to a secluded area of a store, such as a changing room.

20 Claims, 4 Drawing Sheets

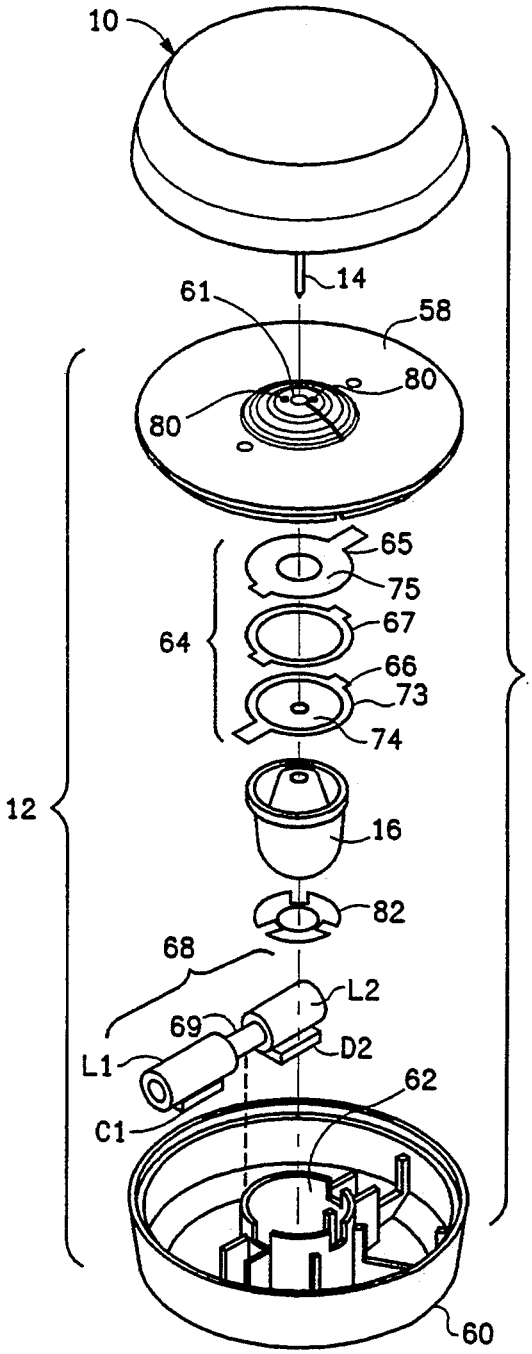
FIG. 1
FIG. 2
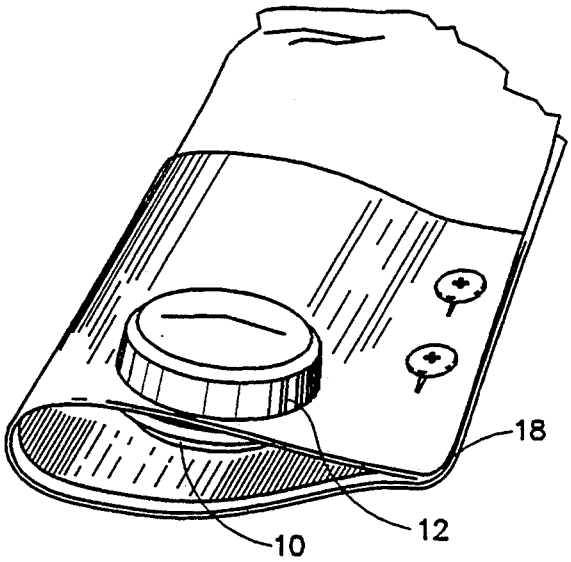
FIG. 3
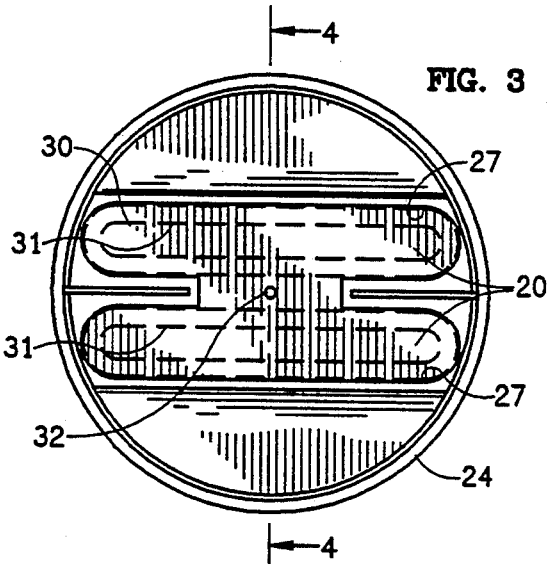
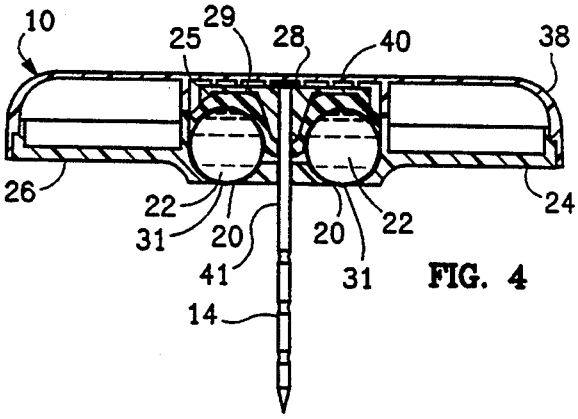
FIG. 4

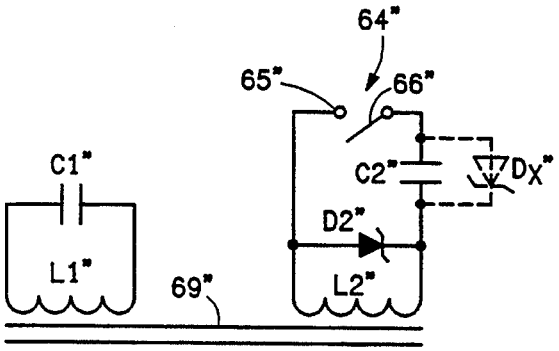
FIG. 9
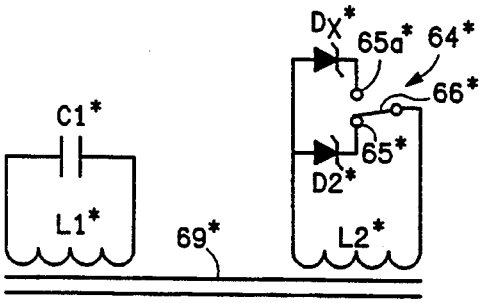
FIG. 10
FIG. 11
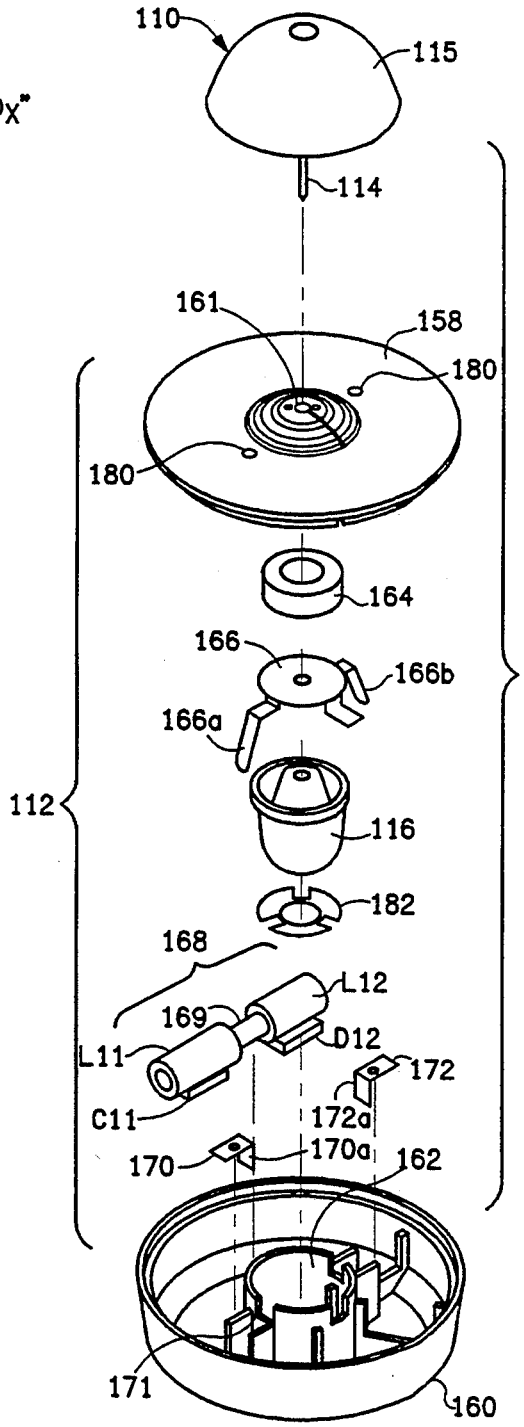

THEFT-DETERRENT DEVICE PROVIDING FORCE-SENSITIVE TAMPER DETECTION

BACKGROUND OF THE INVENTION

The present invention generally pertains to theft-deterrent devices and is particularly directed to an improvement in pin-and-clutch theft-deterrent devices.

A pin-and-clutch theft-deterrent device includes means for attaching the device to the article, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart.

One type of pin-and-clutch theft-deterrent device includes means, such as a transponder, that enables the presence of the theft-deterrent device within a surveillance zone to be detected. An interrogation signal is irradiated throughout the surveillance area, which typically is near a store exit, and the transponder responds to the interrogation signal by radiating a presence detection signal if the theft-deterrent device has not been removed from the protected article prior to entering the surveillance area. Transponders for use in theft-deterrent devices are described in U.S. Pat. No. 4,481,428 to Lincoln H. Charlot, Jr., U.S. Pat. No. 4,670,740 to Fred Wade Herman and Lincoln H. Chariot, Jr., U.S. Pat. No. 4,727,360 to Lucian G. Ferguson and Lincoln H. Charlot, Jr., U.S. Pat. No. 5,065,137 to Fred Wade Herman and U.S. Pat. No. 5,065,138 to Ming R. Lian and Fred Wade Herman.

Another type of pin-and-clutch theft-deterrent device includes a fragile vial containing a detrimental substance that would damage an article attached to the device if the vial were to be fractured, whereby the detrimental substance would be released onto the attached article. The vial is disposed in at least one of the two components in such a manner as to fracture when at least a predetermined pressure is applied thereto by application to the two components of at least a predetermined threshold separation force that is less than that required to overcome the predetermined retaining force. This type of theft-deterrent device is described in U.S. Pat. No. 5,031,287 to Lincoln H. Charlot, Jr. and Carter W. Clarke, Jr., U.S. Pat. No. 4,944,075 to Dennis L. Hogan and U.S. Pat. No. 5,054,172 to Dennis L. Hogan, John L. Lynch and Lincoln H. Charlot, Jr.

Some pin-and-clutch theft-deterrent devices include both transponders and vials containing detrimental substances.

When pin-and-clutch theft-deterrent devices are used to deter the theft of merchandise in stores, the theft-deterrent device is removed from the protected article of merchandise by authorized store personnel when the merchandise is purchased.

Some thieves tamper with pin-and-clutch theft-deterrent devices in order to remove the theft-deterrent device from the protected article by attempting to separate the pin-containing component from the clutch-containing component while in a secluded area of a store, such as a garment changing room.

SUMMARY OF THE INVENTION

The present invention provides a pin-and-clutch theft-deterrent device that provides for instantaneous detection of such tampering with the theft-deterrent device by a would-be thief.

The theft-deterrent device of the present invention includes means for attaching the device to an article to be protected, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart; an electrical switch having contact elements disposed in one of the two components such that the state of the switch is changed by application to the two components of at least a predetermined threshold separation force applied in opposition to said predetermined retaining force; and a transponder coupled to the switch for responding to an irradiated interrogation signal by radiating an alarm signal when the switch changes state in response to application to the two components of at least said predetermined threshold separation force; wherein one of the contact elements includes a rim and a dome that is deflected relative to the rim in accordance with the direction in which the force is applied to the dome, and another one of the contact elements includes a ring that contacts the dome when the dome is reflected to a given position with respect to the rim.

In another aspect, the theft-deterrent device of the present invention includes means for attaching the device to the article, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart; an electrical switch having contact elements disposed in one of the two components such that the state of the switch is changed by application of the two components of at least a predetermined threshold separation force applied in opposition to said predetermined retaining force to thereby detect said application of at least said predetermined threshold separation force; and a transponder coupled to the switch for responding to an irradiated interrogation signal by radiating an alarm signal when the switch changes state in response to application to the two components of at least said predetermined threshold separation force; wherein the switch is a momentary contact switch that does not maintain said changed state after said predetermined threshold separation force is no longer applied.

In still another aspect, the theft-deterrent device of the present invention includes means for attaching the device to the article, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart; means for detecting application to the two components of at least a first predetermined threshold separation force applied in opposition to said predetermined retaining force; and a transponder coupled to the detecting means for responding to an irradiated interrogation signal by radiating an alarm signal when the detecting means detect application to the two components of at least said first predetermined threshold separation force; wherein at least one of the two components includes at least one opening and at least one fragile vial containing a detrimental substance that damages an article attached to the device when the vial is fractured and the detrimental substance is released from the fractured vial through said at least one opening onto the attached article, with said at least one vial being disposed in said at least one of the two components in such a manner as to fracture when at least a predetermined pressure is applied thereto by application to the two components of at least a second predetermined threshold separation force that is less than that required to overcome said predetermined retaining force and more than said first predetermined threshold separation force.

The present invention further provides a system for detecting attempted removal from a protected article of a theft-deterrence device that includes means for attaching the device to the article, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart, the system including means for detecting application to the two components of at least a predetermined threshold separation force applied in opposition to said predetermined retaining force; a transponder coupled to the detecting means for responding to an irradiated interrogation signal by radiating an alarm signal when the detecting means detect application to the two components of at least said predetermined threshold separation force; and means for detecting said alarm signal wherein at least one of the two components includes at least one opening and at least one fragile vial containing a detrimental substance that damages an article attached to the device when the vial is fractured and the detrimental substance is released from the fractured vial through said at least one opening onto the attached article, with said at least one vial being disposed in said at least one of the two components in such a manner as to fracture when at least a predetermined pressure is applied thereto by application to the two components of at least a second predetermined threshold separation force that is less than that required to overcome said predetermined retaining force and more than said first predetermined threshold separation force.

The present invention still further provides a system for detecting attempted removal from a protected article of a theft-deterrence device that includes means for attaching the device to the article, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart, the system including an electrical switch having contact elements disposed in one of the two components such that the state of the switch is changed by application to the two components of at least a predetermined threshold separation force applied in opposition to said predetermined retaining force to thereby detect said application of at least said predetermined threshold separation force; a transponder coupled to the switch for responding to an irradiated interrogation signal by radiating an alarm signal when the switch changes state in response to application to the two components of at least said predetermined threshold separation force; and means for detecting said alarm signal; wherein the switch is a momentary contact switch that does not maintain said changed state after said predetermined threshold separation force is no longer applied.

Additional features of the present invention are described in relation to the detailed description of the preferred embodiments.

BRIEF DESCRIPTION OF THE DRAWING

FIG. 1 is an exploded perspective view of one preferred embodiment of the theft-deterrent device of the present invention.

FIG. 2 illustrates the attachment of the theft-deterrent device of FIG. 1 to a protected article or clothing.

FIG. 3 is a top plan view of a vial-containing member included in the pin-containing component of the theft-deterrent device of FIG. 1.

FIG. 4 is a sector sectional view of the pin-containing component of the theft-deterrent device of FIG. 1 taken along lines 4—4 in FIG. 3.

FIG. 9 is a schematic circuit diagram of another preferred embodiment of a switch-and-transponder circuit for use in the clutch-containing component of the theft-deterrent device of the present invention.

FIG. 10 is a schematic circuit diagram of still another preferred embodiment of a switch-and-transponder circuit for use in the clutch-containing component of the theft-deterrent device of the present invention.

FIG. 11 is an exploded perspective view of another preferred embodiment of the theft-deterrent device of the present invention.

DETAILED DESCRIPTION

Figure 5:
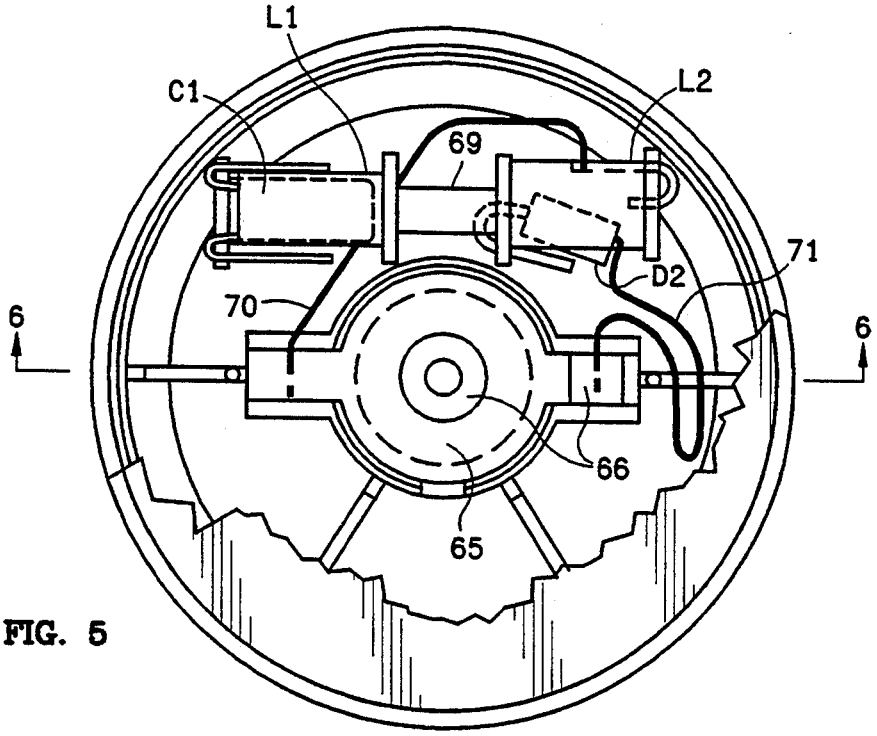
FIG. 5 is a top plan partially-cut-away view of the clutch-containing component of the theft-deterrent device of FIG. 1.

Referring to FIG. 1, a preferred embodiment of the theft-deterrent device of the present invention includes a first component 10 and a second component 12. The first component 10 includes a pin 14, and the second component 12 includes a clutch assembly 16 for grasping the pin 14. The pin 14 is centrally located in the first component 10; and the clutch assembly 16 is centrally located in the second component 12. The theft-deterrent device is attached to an article 18 to be protected (as illustrated in FIG. 2) by passing the pin 14 through a portion of the protected article 18 and engaging the pin 14 in the clutch assembly 16 so that the clutch assembly 16 grasps the pin 14. While the clutch assembly 16 is grasping the pin 14, the first component 10 and the second component 12 are locked together on opposite sides of a portion of the protected article 18 and thereby prevent unauthorized removal of the theft-deterrent device from the protected article 18. The pin 14 has a head 40 (FIG. 4) that is anchored within the first component 10; and the clutch assembly 16 in the second component 12 grasps the pin 14 to provide a predetermined retaining force, such as 100 pounds (25 newtons), for resisting separation of the components 10, 12 by prying or pulling the components apart. The predetermined retaining force must be much greater than the separation force that would be applied in attempting to separate the two components 10, 12 by using one's bare hands.

The pin 14, the clutch assembly 16 and the technique of releasing the pin 14 from the grasp of the clutch assembly 16 so that the first component 10 can be unlocked from the second component 12 to thereby detach the protected article 18 from the theft-deterrent device are described in U.S. Pat. No. 4,523,356 to Lincoln H. Chariot, Jr.

Referring to FIGS. 1, 3 and 4, the first component 10 includes a member 24 that contains two fragile elongated glass vials 20 that fracture when at least a predetermined pressure is applied thereto. Each vial 20 contains a detrimental substance 22 that would damage the protected article 18 if the vial were to be fractured while the theft-deterrent device was attached to the article 18. The detrimental substance 22 preferably is a fluid colored dye or permanent ink.

The first component 10 also includes a circular plastic cover 38. The member 24 and the cover 38 define a head space 25 in which the pinhead 40 is anchored. The head space 25 also enables limited axial movement of the pinhead 40. The pin 14 passes through a hole 41 in an exposed surface 26 of the member 24.

The exposed surface 26 of the member 24 further includes openings 31 into two chambers 27 defined by the member 24 for respectively disposing the two vials 20 adjacent such openings 31. The openings 31 are smaller than the vials 20 so as to recess the vials 20 from the exposed surface 26 and thereby prevent the vials 20 from being fractured during normal handling of the component 10.

The pinhead 40 includes a breaker element 28 and a flange 29. The breaker element 28 exerts little or no pressure on the vials 20 while the attached pin 14 and clutch are in a relaxed state, which occurs when no force is being applied to separate the two components 10, 12.

The breaker element 28 has a wedge-shaped surface for applying more than the predetermined pressure against the vials 20 in response to the pinhead 40 being moved in response to application to the two components 10, 12 of at least a predetermined threshold separation force, such as approximately 40 pounds (10 newtons), that is nevertheless less than that required to overcome the predetermined retaining force, to thereby fracture the vials 20 and release the substance 22 contained therein before the components 10, 12 are separated by prying or pulling the components apart. The predetermined threshold separation force must be well above both normal handling forces for the theft-deterrent device and the separation force that would be applied in attempting to separate the two components 10, 12 by using one's bare hands.

The vials 20 are elongated with closed ends and are disposed in relation to the pinhead 40 such that the breaker element 28 can apply pressure to induce a high bending stress in the vials 20 and thereby completely fracture the vials 20.

The vials 20 are symmetrically disposed in relation to the pinhead 40 so that the pinhead 40 applies approximately equal pressure to both vials 20.

A pliable seal 30 is disposed between the breaker element 28 and the vials 20. The seal 30 includes a hole 32 through which the pin 14 passes. The pliable seal 30 is disposed between the breaker element 28 and the vials 20 for preventing the detrimental substance 22 that is released from the fractured vials 20 from entering the head space 25 and for expelling the released detrimental substance 22 through the openings 31 in response to pressure applied against the seal 30 by the breaker element by the movement of the pinhead that results in the vial being fractured.

The seal 30 is more extensive than the breaker element 28; and the flange 29 of the pinhead 40 extends beyond the breaker element for contacting the seal 30 beyond the breaker element 28 for further forcing the seal 30 to expel the released detrimental substance 22 through the openings 31 in response to pressure applied against the seal 30 by the flange 29 by the movement of the pinhead 40 that results in the vials 20 being fractured.

When forced separation of the two components 10, 12 is attempted, the pin 14 is forced to move axially within the vial-containing member 24 and the breaker element 28 of the pinhead 40 applies pressure against the vials 20 to fracture the vials 20.

The first component 10 is further described in the aforementioned U.S. Pat. No. 5,054,172.

Figure 6:
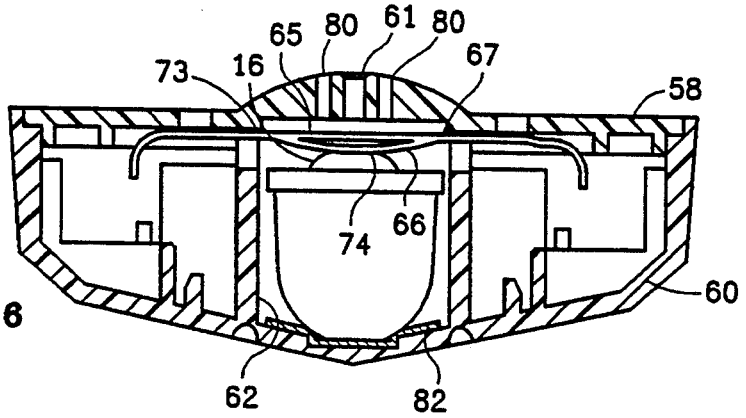
FIGS. 6 is a sector sectional view of the clutch-containing component of the theft-deterrent device of FIG. 1 taken along lines 6—6 in FIG. 5.

Referring to FIGS. 1, 5 and 6, the second component 12 includes a casing consisting of a plastic cover 58 and a plastic barrel 60. The cover 58 includes a hole 61 for receiving the pin 14. The barrel 60 includes a central chamber 62 that holds the clutch assembly 16.

Disposed between the clutch assembly 16 and the cover 58 is a switch assembly 64 including a fixed contact element 65, a movable contact element 66 and an insulating ring 67.

Figure 7:
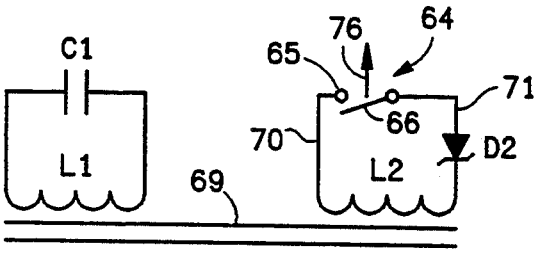
FIG. 7 is a schematic circuit diagram of one preferred embodiment of a switch-and-transponder circuit for use in the clutch-containing component of the theft-deterrent device of the present invention.

Also disposed in the barrel 60 is a transponder assembly 68, including a first inductance coil L1 and a second inductance coil L2 disposed on a ferrite rod 69, a capacitor C1 and a variable capacitance diode D2. The first inductance coil L1 and the capacitor C1 are connected in parallel to provide a first resonant circuit. A first conductive wire 70 connects the fixed contact element 65 to one side of the second inductance coil L2 and a second conductive wire 71 connects the movable contact element 66 to one side of the diode D2, as shown in FIGS. 5 and 7. As further shown in FIG. 7, the other side of the second inductance coil L2 is connected to the other side of the diode D2 so that closure of the switch assembly 64 to effect contact between the fixed contact element 65 and the movable contact element 66 provides a second resonant circuit and enables the transponder assembly 68 to function as a transponder as described in the aforementioned U.S. Pat. No. 5,065,137.

The movable contact element 66 includes a conductive perimetric rim 73 and a conductive dome 74 Joining the inside of the rim 73 that is deflectable from one side of the rim 73 to the other in accordance with the direction in which a force is applied to the dome 74. The fixed contact element 65 includes a conductive ring 75 that contacts the dome 74 when the dome 74 is deflected from the side of the rim 73 facing the clutch assembly 16 to the other side of the rim 73. The movable contact element 66 is made of a spring material, such as phosphor-bronze or beryllium-copper.

Application of at least a predetermined separation force to the two components 10 and 12 applied in opposition to the predetermined retaining force provided by the pin 14 and the clutch assembly 16 during an attempt to separate the two components 10 and 12 by prying the components 10 and 12 apart results in relative movement between the clutch assembly 16 and the cover 58 that causes the clutch assembly 16 to engage the dome 74 of the movable contact element 66 and force the dome 74 to deflect to the other side of the rim 73 to thereby contact the ring 75 of the fixed contact element 65. The direction in which the separation force is applied is indicated by an arrow 76 in FIG. 7. Preferably, the predetermined separation force required to force the dome 74 to deflect to the other side of the rim 73 to contact the fixed contact element 65 is less than both the predetermined separation force required to fracture the vials 20 and the separation force required to overcome the predetermined retaining force provided by the pin 14 and the clutch assembly 16.

The movable contact element 66 may be made to provide either a bistable switch or a momentary switch by adjusting the thickness of the insulating ring 67 and/or the interior diameter of the fixed contact element 65 so that the dome 74 either can or cannot deflect sufficiently to assume a stable deflected state when in contact with the fixed contact element 65. The bistable switch maintains a changed contact relationship even after the predetermined threshold separation force required to effect contact between the contact elements 65 and 66 is no longer applied; whereas the momentary switch does not maintain a changed contact relationship after the predetermined threshold separation force required to effect contact between the contact elements 65 and 66 is no longer applied.

Referring to FIG. 7, the first resonant circuit L1. C1 is resonant at a first frequency $f_1$ for receiving an interrogation signal in the form of electromagnetic radiation at the first frequency $f_1$; and the second resonant circuit L2, D2 is resonant at a second frequency $f_2$ that is one-half the first frequency $f_1$ for transmitting an alarm signal in the form of electromagnetic radiation at the second frequency $f_2$.

The first circuit L1, C1 is coupled only magnetically by the ferrite rod 69 and air to the second circuit L2, D2 to transfer energy to the second circuit L2, D2 at the first frequency $f_1$ in response to receipt by the first circuit L1, C1 of electromagnetic radiation at the first frequency $f_1$. The variable capacitance diode D2 in the second circuit L2, D2 is a variable reactance element in which the reactance varies with variations in energy transferred from the first circuit L1, C1 for causing the second circuit L2. D2 to transmit electromagnetic radiation at the second frequency $f_2$ in response to the energy transferred from the first circuit L1, C1 at the first frequency $f_1$.

The switch assembly 64 detects application to the two components 10, 12 in opposition to the retaining force provided by the pin 16 and the clutch assembly 16 of at least the predetermined threshold separation force required to effect contact between the contact elements 65 and 66; and the transponder 68 is coupled to the switch assembly 64 for responding to an irradiated interrogation signal at the first frequency $f_1$ by radiating an alarm signal at the second frequency $f_2$ when the switch assembly 64 detects application to the two components 10, 12 of at least the predetermined threshold separation force by changing the contact relationship between the contact elements 65, 66 in response to application to the two components 10, 12 of at least the predetermined threshold separation force. The transponder radiates the alan signal when the switch contact elements 65, 66 are in the changed contact relationship.

The cover 58 includes a pair of holes 80 on opposite sides of the center hole 61 for receiving a U-shaped tool that may be inserted for deflecting the dome 74 toward the clutch assembly 16 by applying force to the dome 74 with the tool, to thereby reset the switch contact elements 65, 66 to their unchanged contact relationship.

The second component 12 also includes a deflection plate 82 made of two-percent-carbon hardened spring steel, which lines the central chamber 62 around the clutch assembly 16 for deflecting the bit of a drill that one might use in an attempt to penetrate the housing of the clutch assembly 16, and thereby shield the housing of the clutch assembly 16 from a drilling tool.

The second component 12 is further described in the aforementioned U.S. Pat. No. 5,054,172.

Figure 8:
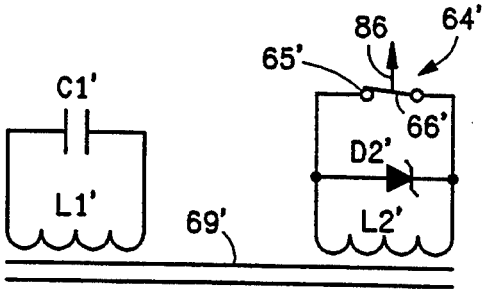
FIG. 8 is a schematic circuit diagram of an alternative preferred embodiment of a switch-and-transponder circuit for use in the clutch-containing component of the theft-deterrent device of the present invention.

In an alternative preferred embodiment, as shown in FIG. 8, a first inductance coil L1' is connected in parallel with a capacitor C1' to provide a first resonant circuit, a second inductance coil L2' is connected in parallel with a variable capacitance diode D2' to provide a second resonant circuit and a normally-closed switch 64' is connected across the diode D2'. The first resonant circuit L1', C1' is coupled only magnetically by a ferrite rod 69' and air to the second resonant circuit L2', D2'. The first resonant circuit L1', C1' is resonant at a first frequency $f_1$ for receiving an interrogation signal in the form of electromagnetic radiation at the first frequency $f_1$; and the second resonant circuit L2', D2' is resonant at a second frequency $f_2$ that is one-half the first frequency $f_1$ for transmitting an alarm signal in the form of electromagnetic radiation at the second frequency $f_2$.

The normally closed switch 64' includes a fixed contact element 65' and a movable contact element 66', which are identical to the fixed contact element 65 and the movable contact element 66, respectively, in the switch assembly 64 in the embodiment of FIGS. 1, 5 and 6, except that the positions of the fixed and movable contact elements are interchanged. Accordingly the application of at least a predetermined separation force to the two components 10 and 12 applied in opposition to the predetermined retaining force provided by the pin 14 and the clutch assembly 16 during an attempt to separate the two components 10 and 12 by prying the components 10 and 12 apart results in relative movement between the clutch assembly 16 and the cover 58 that causes the clutch assembly 16 to engage the dome 74 of the movable contact element 66 and force the dome 74 to deflect to the other side of the rim 73 to thereby break contact with the ring 75 of the fixed contact element 65. The direction in which the separation force is applied is indicated by an arrow 86 in FIG. 8.

In the embodiment of FIG. 8, the switch assembly 64' detects application to the two components 10, 12 in opposition to the retaining force provided by the pin 14 and the clutch assembly 16 of at least the predetermined threshold separation force required to break contact between the contact elements 65' and 66'; and the transponder L1', C1', 69' L2', D2' is coupled to the switch assembly 64' for responding to an irradiated interrogation signal at the first frequency $f_1$ by radiating an alarm signal at the second frequency $f_2$ when the switch assembly 64' detects application to the two components 10, 12 of at least the predetermined threshold separation force by changing the contact relationship between the contact elements 65', 66' in response to application to the two components 10, 12 of at least the predetermined threshold separation force. The transponder radiates the alarm signal when the switch contact elements 65', 66' are in the changed contact relationship.

In the alternative preferred embodiments shown in FIGS. 9 and 10, the transponder and switch circuit is modified so that the transponder responds to the irradiated interrogation signal by radiating a first signal when the switch contact elements are not in the changed contact relationship and by radiating the alarm signal when the switch contact elements are in the changed contact relationship.

Referring to FIG. 9, a first inductance coil L1'' is connected in parallel with a capacitor C1'' to provide a first resonant circuit, a second inductance coil L2'' is connected in parallel with a variable capacitance diode D2'' to provide a second resonant circuit and a normally-open switch 64'' is connected in series with a capacitance C2'' (or alternatively, in series with a variable capacitance diode $D_X''$, as shown by dashed lines) across the diode D2'' and the second inductance coil L2''. The first resonant circuit L1'', C1'' is coupled only magnetically by a ferrite rod 69'' and air to the second resonant circuit L2'', D2''. The first resonant circuit L1'', C1'' is resonant at a first frequency $f_1$ for receiving an interrogation signal in the form of electromagnetic radiation at the first frequency $f_1$; and the second resonant circuit L2'', D2'' is resonant at a second frequency $f_2$ that is one-half the first frequency $f_1$.

The normally open switch 64'' includes a fixed contact element 65'' and a movable contact element 66'', which are identical to the fixed contact element 65 and the movable contact element 66, respectively, in the switch assembly 64 in the embodiment of FIGS. 1, 5 and 6. When the switch 64, is open, the transponder functions as a transponder for an electronic article surveillance (EAS) system in that it responds to an irradiated interrogation signal at the first frequency $f_1$ by radiating a presence detection signal at the second frequency $f_2$. The interrogation signal at the first frequency $f_1$ is radiated throughout a surveillance zone of an EAS system near the exit of a store.

When the switch 64'' is closed by application of at least a predetermined separation force to the two components 10 and 12 in opposition to the predetermined retaining force provided by the pin 14 and the clutch assembly 16 during an attempt to separate the two components 10 and 12 by prying the components 10 and 12 apart, the capacitance C2'' (or the diode $D_X''$) is connected across the diode D2'' and the second inductance L2'' to form a third resonant circuit that is resonant at a third frequency $f_3$ that is different than the second frequency $f_2$; and the transponder responds to an irradiated interrogation signal at a frequency $2f_3$ that is twice the third resonant frequency $f_3$ by radiating an alarm signal at the third resonant frequency $f_3$. The interrogation signal at the frequency $2f_3$ is radiated throughout a secluded area, such as a changing room, within a store.

Referring to FIG. 10, a first inductance coil L1* is connected in parallel with a capacitor C1* to provide a first resonant circuit, a second inductance coil L2* is connected in parallel with a first variable capacitance diode D2* when a switch 64* is in its normal position, as shown in FIG. 10, to provide a second resonant circuit and is connected in parallel with a second variable capacitance diode $D_X^*$ when the switch 64* is in its changed position to provide a third resonant circuit. The first resonant circuit L1*, C1* is coupled only magnetically by a ferrite rod 69* and air to the second resonant circuit L2*, D2* or the third resonant circuit L2*, $D_X^*$. The first resonant circuit L1*, C1* is resonant at a first frequency $f_1$ for receiving an interrogation signal in the form of electromagnetic radiation at the first frequency $f_1$; and the second resonant circuit L2*, D2* is resonant at a second frequency $f_2$ that is one-half the first frequency $f_1$. The third resonant circuit is resonant at a third frequency $f_3$ that is different than the second frequency $f_2$.

The switch 64* includes a first fixed contact element 65* and a movable contact element 66*, which are identical to the fixed contact element 65 and the movable contact element 66, respectively, in the switch assembly 64 in the embodiment of FIGS. 1, 6 and 6, and a second fixed contact element 65a*, which is identical to the first fixed contact element 65* and is positioned between the movable fixed contact element 66* and the clutch assembly 16, with an insulating washer like washer 67 being positioned between the second fixed contact element 65a* and the movable contact element 66*. When the switch 64* is in its normal position with the movable contact element 66*. When the switch the first fixed contact element 65*, the transponder functions as a transponder for an EAS system in that it responds to an irradiated interrogation signal at the first frequency $f_1$ by radiating a presence detection signal at the second frequency $f_2$. The interrogation signal at the first frequency $f_1$ is radiated throughout a surveillance zone of an EAS system near the exit of a store.

When the position of the switch 64* is changed by application of at least a predetermined separation force to the two components 10 and 12 in opposition to the predetermined retaining force provided by the pin 14 and the clutch assembly 16 during an attempt to separate the two components 10 and 12 by prying the components 10 and 12 apart, so that the movable contact element 66* contacts the second fixed contact element 65a*, the transponder responds to an irradiated interrogation signal at a frequency $2f_3$ that is twice the third resonant frequency $f_3$ by radiating an alarm signal at the third resonant frequency $f_3$. The interrogation signal at the frequency $2f_3$ is radiated throughout a secluded area, such as a changing rom, within a store.

Figure 12:
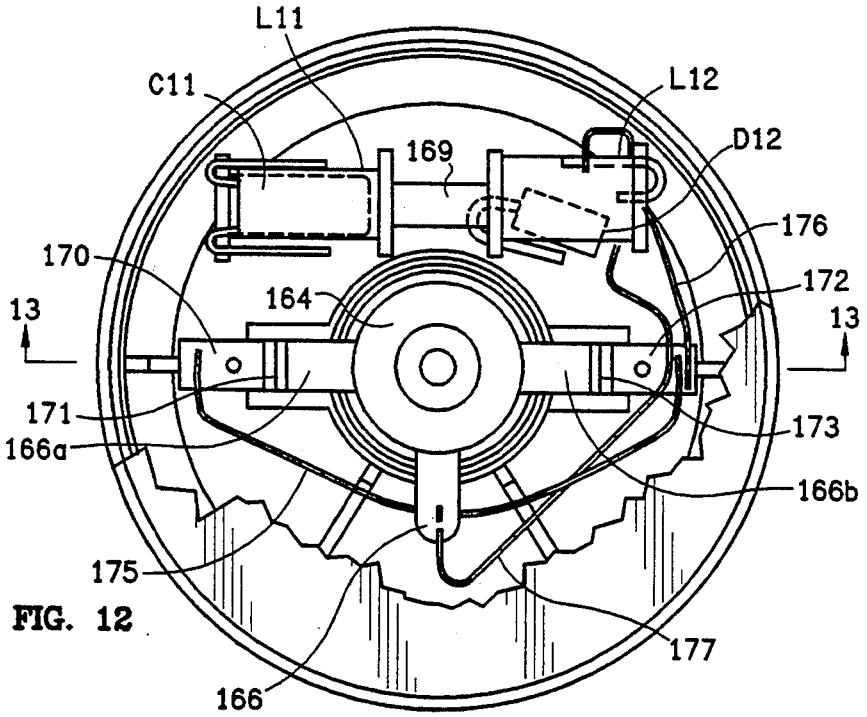
FIG. 12 is a top plan partially-cut-away view of the clutch-containing component of the theft-deterrent device of FIG. 11.
Figure 13:
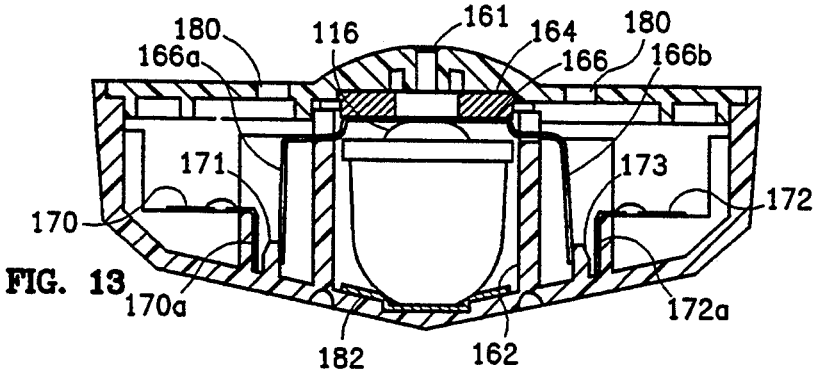
FIG. 13 is a sector sectional view of the clutch-containing component of the theft-deterrent device of FIG. 11 taken along lines 13—13 in FIG. 12.

Another preferred embodiment of the theft-deterrent device of the present invention is shown in FIGS. 11, 12 and 13. This embodiment includes a first component 110 and a second component 112. The first component 110 consists of a pin 114 having a head 115; and the second component 112 includes a clutch assembly 116 for grasping the pin 114. Alternatively, the first component 10 shown in the embodiment of FIGS. 1, 3 and 4 may be substituted for the pin 114. Also the pin 114 may be used in the embodiment of FIG. 1 in lieu of the first component 10. The interaction between the pin 114 and the clutch assembly 116 is the same as the interaction between the pin 14 and the clutch assembly 16 in the embodiment of FIG. 1.

The second component 112 includes a casing consisting of a plastic cover 158 and a plastic barrel 160. The cover 158 includes a hole 161 for receiving the pin 114. The barrel 160 includes a central chamber 162 that holds the clutch assembly 116.

Disposed between the clutch assembly 116 and the cover 158 is a foam sponge 164 and a movable contact element 166. The movable contact element 166 is part of a switch assembly that further includes a pair of L-shaped fixed contact elements 170, 172. The first L-shaped fixed contact element 170 is disposed with one leg 170*a* on one side of a first ridge 171; and the second L-shaped fixed contact element 172 is disposed with one leg 172*a* on one side of a second ridge 173. The movable contact element 166 includes a first finger 166*a* and a second finger 166*b* that are flexible and spring outward from the vertical. When the switch assembly is in its normal position, the first finger 166*a* is forced inward and disposed on the opposite side of the first ridge 171 from the leg 170*a* of the first fixed contact element 170 and the second finger 166*b* is forced inward and disposed on the opposite side of the second ridge 173 from the leg 172*a* of the second fixed contact element 172.

Also disposed in the barrel 160 is a transponder assembly 168, including a first inductance coil L11 and a second inductance coil L12 disposed on a ferrite rod 169, a capacitor C 11 and a variable capacitance diode D 12. The first inductance coil L11 and the capacitor C 11 are connected in parallel to provide a first resonant circuit. A first conductive wire 175 connects the first fixed contact element 170 to the second fixed contact element 172; a second conductive wire 176 connects the second fixed contact element 172 to one side of the second inductance coil L12 and a third conductive wire 177 connects the movable contact element 166 to one side of the diode D12. The other side of the second inductance coil L12 is connected to the other side of the diode D12 so that operation of the switch assembly to connect the one side of the diode D12 to the one side of the second inductance coil L12 provides a second resonant circuit and enables the transponder assembly 168 to function as a transponder as described in the aforementioned U.S. Pat. No. 5,065,137.

Application of at least a predetermined separation force to the two components 110 and 112 applied in opposition to the predetermined retaining force provided by the pin 114 and the clutch assembly 116 during an attempt to separate the two components 110 and 112 by prying the components 110 and 112 apart results in relative movement between the clutch assembly 116 and the cover 158 that causes the clutch assembly 116 to force the movable contact element 166 toward the cover 158 so that at least one of the two fingers 166*a*, 166*b* moves above its respective ridge 171, 173 and springs outward to contact the leg 170*a*, 172*a* of the fixed contact element 170, 172 on the other side of the ridge 171, 173 to thereby connect the one side of the diode D12 to the one side of the second inductance coil L12 and provide a second resonant circuit. Preferably, the predetermined separation force required to force the movable contact element 166 to move enough to complete the connection of the second resonant circuit is less than the predetermined separation force required to overcome the predetermined retaining force provided by the pin 114 and the clutch assembly 116.

The cover 158 includes a pair of holes 180 on opposite sides of the center hole 161 for receiving a U-shaped tool that may be inserted for forcing the fingers 166*a*, 166*b* inward and back into theft respective positions on the opposite sides of the first and second ridges 171, 173 from the first and second fixed contact elements 170, 172, and thereby reset the switch contact elements 166, 170, 172 to their unchanged contact relationship.

The second component 112 also includes a deflection plate 182 which lines the central chamber 162 around the clutch assembly 116.

Figure 14:
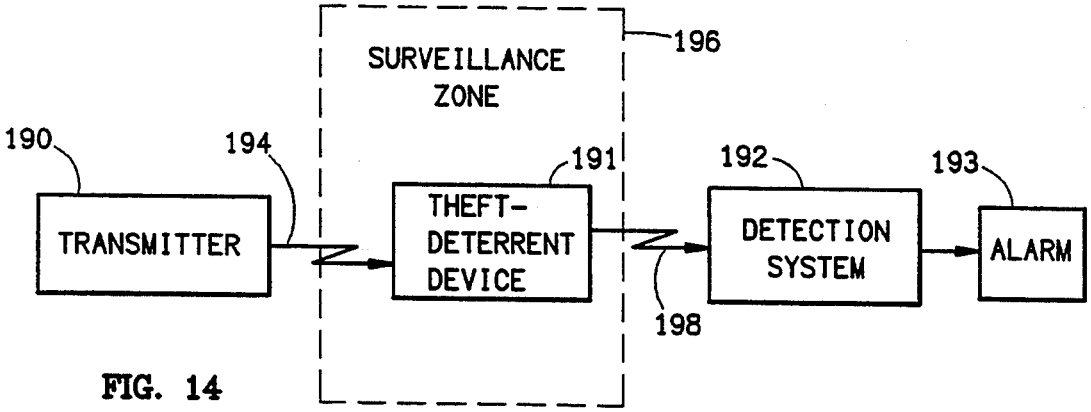
FIG. 14 is a block diagram of a system for detecting attempted removal from a protected article of a theft-deterrence device according to the present invention.

A system for detecting attempted removal from a protected article of a theft-deterrence device according to the present invention is described with reference to FIG. 14. This system includes a transmitter 190, the theft-deterrent device 191, an alarm signal detection system 192 and an alarm device 193.

The transmitter 190 transmits an electromagnetic radiation signal 194 of a first predetermined frequency into a surveillance zone 196 located in a secluded area of a store, such as a changing room.

The theft-deterrent device 191 is attached to an article (not shown) to be protected within the surveillance zone 196. The theft-deterrent device 19 1 is as described above with reference to FIGS. 1 through 13.

The detection system 192 is installed in proximity to the surveillance zone 196 in the secluded area within a store. When someone attempts to remove the theft-deterrent device 19 1 from the protected article by applying to the two components of the theft-deterrent device 19 1 at least a predetermined threshold separation force applied in opposition to the predetermined retaining force, the transponder in the theft-deterrent device 191 responds to the Irradiated interrogation signal 194 by radiating an alarm signal 198 at a second predetermined frequency that is one-half the first predetermined frequency.

The detection system 192 detects the alan signal 198 in the surveillance zone 196 at the second predetermined frequency, and thereby detects force-sensitive tampering with the theft-deterrent device 191 in the surveillance zone 196.

The alarm device 193 is coupled to the detection system 192 and produces an alan in response to detection of the alarm signal 198 by the detection system 192. The alarm device 193 may provide an audible and/or a visual alan at one or more of the following locations: (a) the secluded area, (b) a security office or (c) a sales desk. The alarm device 193 may also activate a video camera in the secluded area and/or some other security device.

This detection system will motivate a would-be thief to cease tampering with the theft-deterrent device and will give security personnel the opportunity to respond immediately to the tampering event.

We claim:

1. A device for deterring theft of a protected article, the device comprising means for attaching the device to the article, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart;

an electrical switch having contact elements disposed in one of the two components such that the state of the switch is changed by application to the two components of at least a predetermined threshold separation force applied in opposition to said predetermined retaining force to thereby detect said application of at least said predetermined threshold separation force; and a transponder coupled to the switch for responding to an irradiated interrogation signal by radiating an alarm signal when the switch changes state in response to application to the two components of at least said predetermined threshold separation force;

wherein one of the contact elements includes a rim and a dome that is deflected relative to the rim in accordance with the direction in which the force is applied to the dome, and another one of the contact elements includes a ring that contacts the dome when the dome is deflected to a given position with respect to the rim.

2. A device according to claim 1, wherein the clutch-containing component includes at least one hole for inserting a tool for deflecting the dome toward the clutch by applying force to the dome with the tool to reset the switch contact elements.

3. A device for deterring theft of a protected article, the device comprising means for attaching the device to the article, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart;

an electrical switch having contact elements disposed in one of the two components such that the state of the switch is changed by application to the two components of at least a predetermined threshold separation force applied in opposition to said predetermined retaining force to thereby detect said application of at least said predetermined threshold separation force; and a transponder coupled to the switch for responding to an irradiated interrogation signal by radiating an alarm signal when the switch changes state in response to application to the two components of at least said predetermined threshold separation force;

wherein the switch is a momentary contact switch that does not maintain said changed state after said predetermined threshold separation force is no longer applied.

4. A device according to claim 3, wherein, one of the contact elements includes a rim and a dome that is deflected relative to the rim in accordance with the direction in which the force is applied to the dome, and another one of the contact elements includes a ring that contacts the dome when the dome is deflected to a given position with respect to the rim.

5. A device according to claim 4, wherein the transponder is adapted to respond to the irradiated interrogation signal when the state of the switch is unchanged by radiating a response signal that is different than said alarm signal.

6. A device for deterring theft of a protected article, the device comprising means for attaching the device to the article, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart;

means for detecting application to the two components of at least a first predetermined threshold separation force applied in opposition to said predetermined retaining force; and a transponder coupled to the detecting means for responding to an irradiated interrogation signal by radiating an alarm signal when the detecting means detect application to the two components of at least said first predetermined threshold separation force;

wherein at least one of the two components includes at least one opening and at least one fragile vial containing a detrimental substance that damages an article attached to the device when the vial is fractured and the detrimental substance is released from the fractured vial through said at least one opening onto the attached article, with aid at least one vial being disposed in said at least one of the two components in such a manner as to fracture when at least a predetermined pressure is applied thereto by application to the two components of at least a second predetermined threshold separation force that is less than that required to overcome said predetermined retaining force and more than said first predetermined threshold separation force.

7. A device according to claim 6, wherein the detecting means comprises an electrical switch having contact elements disposed in one of the two components such that the state of the switch is changed by application to the two components of at least said first predetermined threshold separation force applied in opposition to said predetermined retaining force to thereby detect said application of at least said first predetermined threshold separation force;

wherein the transponder is coupled to the switch for responding to said irradiated interrogation signal by radiating said alarm signal when the switch changes state in response to application to the two components of at least said first predetermined threshold separation force; and wherein the switch is a momentary contact switch that does not maintain said changed state after said first predetermined threshold separation force is no longer applied.

8. A device according to claim 6, wherein the detecting means comprises an electrical switch having contact elements disposed in one of the two components such that the state of the switch is changed by application to the two components of at least a predetermined threshold separation force applied in opposition to said predetermined retaining force to thereby detect said application of at least said first predetermined threshold separation force;

wherein the transponder is coupled to the switch for responding to said irradiated interrogation signal by radiating said alarm signal when the switch changes state in response to application to the two components of at least said first predetermined threshold separation force; and wherein one of the contact elements includes a rim and a dome that is deflected relative to the rim in accordance with the direction in which the force is applied to the dome, and another one of the contact elements includes a ring that contacts the dome when the dome is deflected to a given position with respect to the rim.

9. A device according to claim 8, wherein the clutch-containing component includes at least one hole for inserting a tool for deflecting the dome toward the clutch by applying force to the dome with the tool to reset the switch contact elements.

10. A system for detecting attempted removal from a protected article of a theft-deterrence device that includes means for attaching the device to the article, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart, the system including means for detecting application to the two components of at least a first predetermined threshold separation force applied in opposition to said predetermined retaining force;

a transponder coupled to the detecting means for responding to an irradiated interrogation signal by radiating an alarm signal when the detecting means detect application to the two components of at least said first predetermined threshold separation force; and means for detecting said alarm signal;

wherein at least one of the two components includes at least one opening and at least one fragile vial containing a detrimental substance that damages an article attached to the device when the vial is fractured and the detrimental substance is released from the fractured vial through said at least one opening onto the attached article, with said at least one vial being disposed in said at least one of the two components in such a manner as to fracture when at least a predetermined pressure is applied thereto by application to the two components of at least a second predetermined threshold separation force that is less than that required to overcome said predetermined retaining force and more than said first predetermined threshold separation force.

11. A system according to claim 10, wherein the means for detecting the alarm signal are installed in proximity to a secluded area within a store, the system further comprising means for radiating said interrogation signal within said secluded area.

12. A system according to claim 10, wherein the detecting means comprises an electrical switch having contact elements disposed in one of the two components such that the state of the switch is changed by application to the two components of at least said first predetermined threshold separation force applied in opposition to said predetermined retaining force to thereby detect said application of at least said first predetermined threshold separation force;

wherein the transponder is coupled to the switch for responding to said irradiated interrogation signal by radiating said alarm signal when the switch changes state in response to application to the two components of at least said first predetermined threshold separation force; and wherein the switch is a momentary contact switch that does not maintain said changed state after said first predetermined threshold separation force is no longer applied.

13. A system according to claim 12, wherein the means for detecting the alarm signal are installed in proximity to a secluded area within a store, the system further comprising means for radiating said interrogation signal within said secluded area.

14. A system according to claim 10, wherein the detecting means comprises an electrical switch having contact elements disposed in one of the two components such that the state of the switch is changed by application to the two component of at least a predetermined threshold separation force applied in opposition to said predetermined retaining force to thereby detect said application of at least said first predetermined threshold separation force;

wherein the transponder is coupled to the switch for responding to said irradiated interrogation signal by radiating said alarm signal when the switch changes state in response to application to the two components of at least said first predetermined threshold separation force; and wherein one of the contact elements includes a rim and a dome that is deflected relative to the rim in accordance with the direction in which the force is applied to the dome, and another one of the contact elements includes a ring that contacts the dome when the dome is deflected to a given position with respect to the rim.

15. A system according to claim 14, wherein the clutch containing component includes at least one hole for inserting a tool for deflecting the dome toward the clutch by applying force to the dome with the tool to reset the switch contact elements.

16. A system according to claim 10, wherein the transponder is adapted to respond to the irradiated interrogation signal when the state of the switch is unchanged by radiating a response signal that is different than said alarm signal.

17. A system for detecting attempted removal from a protected article of a theft-deterrence device that includes means for attaching the device to the article, with said attaching means being embodied in two components that are adapted to be locked together on opposite sides of a portion of said article to prevent unauthorized removal of the device from the article, wherein the attaching means include a pin that is anchored within one component and a clutch contained in the other component for grasping the pin to provide a predetermined retaining force for resisting separation of the components by prying or pulling the components apart, the system including an electrical switch having contact elements disposed in one of the two component such that the state of the switch is changed by application to the two components of at least a predetermined threshold separation force applied in opposition to said predetermined retaining force to thereby detect said application of at least said predetermined threshold separation force;

a transponder coupled to the switch for responding to an irradiated interrogation signal by radiating an alarm signal when the switch changes state in response to application to the two components of at least said predetermined threshold separation force; and means for detecting said alarm signal;

wherein the switch is a momentary contact switch that does no maintain said changed state after said predetermined threshold separation force is no longer applied.

18. A system according to claim 17, wherein the means for detecting the alarm signal are installed in proximity to a secluded area within a store, the system further comprising means for radiating said interrogation signal within said secluded area.

19. A system according to claim 17, wherein one of the contact elements includes a rim and a dome that is deflected relative to the rim in accordance with the direction in which the force is applied to the dome, and another one of the contact elements includes a ring that contacts the dome when the dome is deflected to a given position with respect to the rim.

20. A system according to claim 17, wherein the transponder is adapted to respond to the irradiated interrogation signal when the state of the switch is unchanged by radiating a response signal that is different than said alarm signal.

* * * * *